US011114823B2

(12) United States Patent
Strangfeld et al.

(10) Patent No.: US 11,114,823 B2
(45) Date of Patent: Sep. 7, 2021

(54) NON-ROTATIONALLY SYMMETRICAL SPARK GAP, IN PARTICULAR HORN SPARK GAP WITH DEION CHAMBER

(71) Applicant: DEHN SE + CO KG, Neumarkt/Opf. (DE)

(72) Inventors: Uwe Strangfeld, Nuremberg (DE); Stephan Hierl, Neumarkt (DE); Stefan Schön, Seubersdorf (DE)

(73) Assignee: DEHN SE + CO KG, Neumarkt/Opf. (DE)

( * ) Notice: Subject to any disclaimer, the term of this patent is extended or adjusted under 35 U.S.C. 154(b) by 0 days.

(21) Appl. No.: 16/652,070

(22) PCT Filed: Apr. 9, 2019

(86) PCT No.: PCT/EP2019/058899
§ 371 (c)(1),
(2) Date: Mar. 29, 2020

(87) PCT Pub. No.: WO2019/223928
PCT Pub. Date: Nov. 28, 2019

(65) Prior Publication Data

US 2021/0066894 A1 Mar. 4, 2021

(30) Foreign Application Priority Data

May 24, 2018 (DE) ..... 10 2018 112 428.7
Jul. 17, 2018 (DE) ..... 10 2018 117 275.3

(51) Int. Cl.
*H01T 1/02* (2006.01)
*H01T 4/04* (2006.01)
*H01T 4/14* (2006.01)

(52) U.S. Cl.
CPC ..... *H01T 1/02* (2013.01); *H01T 4/04* (2013.01); *H01T 4/14* (2013.01)

(58) Field of Classification Search
None
See application file for complete search history.

(56) References Cited

U.S. PATENT DOCUMENTS 5,754,385 A 5/1998 Altmaier et al. ..... 361/118
9,019,680 B2 4/2015 Hierl et al. ..... 361/137
(Continued)

FOREIGN PATENT DOCUMENTS

CN 103069672 A 4/2013 ..... H01T 4/14
CN 103098323 A 5/2013 ..... H01T 1/02
(Continued)

OTHER PUBLICATIONS

Office Action (in German), dated Jan. 4, 2019, issued by the German Patent Office for Applicant's corresponding German Patent Application No. DE102018117275.3, filed Jul. 17, 2018.
(Continued)

*Primary Examiner* — Ashok Patel
(74) *Attorney, Agent, or Firm* — Bodner & O'Rourke, LLP; Gerald T. Bodner; Christian P. Bodner

(57) ABSTRACT

The invention relates to a non-rotationally symmetrical spark gap, in particular a horn spark gap with a deion chamber, a multi-part insulating material housing (1) as a support and receiving body for the horn electrodes and the deion chamber, means for conducting the gas flow related to the arc, wherein the insulating material housing (1) is divided on the plane defined by the horn electrodes and has two half shells, and plug or screw connections (4, 5) which lead out on the end face. According to the invention, with the exception of the sections of the plug or screw connections (4, 5) leading out, the insulating material housing is surrounded on all sides by a cooling surface (14) which is near the housing and lies against the housing surface, and the cooling surface (14) is at least partly supported on webs (8)
(Continued)

which are designed to conduct the gas flow on the outer surface of the half shells.

10 Claims, 2 Drawing Sheets

(56) References Cited

U.S. PATENT DOCUMENTS

| | | | | |
|---|---|---|---|---|
| 9,083,153 | B2 | 7/2015 | Ehrhardt et al. | |
| 9,178,335 | B2 | 11/2015 | Waffler et al. | |
| 9,646,784 | B2 | 5/2017 | Ignatov et al. | |
| 2019/0080826 | A1* | 3/2019 | Kamensek | H02H 9/04 |

FOREIGN PATENT DOCUMENTS

| | | | | |
|---|---|---|---|---|
| CN | 203747240 | U | 7/2014 | H01T 1/06 |
| CN | 105659344 | A | 6/2016 | H01H 9/34 |
| DE | 4439730 | A1 | 4/1996 | H01T 4/10 |
| DE | 19506057 | A1 | 9/1996 | H01T 1/08 |
| DE | 102005015401 | A1 | 7/2006 | H01T 1/04 |
| DE | 102011051738 | A1 | 2/2012 | H01T 1/08 |
| DE | 102011102257 | A1 | 2/2012 | H01T 1/02 |
| DE | 102013112400 | A1 | 6/2014 | H01T 1/02 |
| DE | 102016115223 | A1 | 5/2017 | H01T 1/00 |
| EP | 0706245 | A2 | 4/1996 | H01T 4/10 |
| WO | WO2006074721 | A1 | 7/2006 | H01T 4/14 |

OTHER PUBLICATIONS

The Written Opinion of the International Searching Authority, in German, dated Jul. 19, 2019, which was issued by the International Bureau of WIPO in Applicant's corresponding international PCT application having Serial No. PCT/EP2019/058899, filed on Apr. 9, 2019.

The International Search Report, in English, dated Jul. 19, 2019, which was issued by the International Bureau of WIPO in Applicant's corresponding international PCT application having Serial No. PCT/EP2019/058899, filed on Apr. 9, 2019.

* cited by examiner

NON-ROTATIONALLY SYMMETRICAL SPARK GAP, IN PARTICULAR HORN SPARK GAP WITH DEION CHAMBER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

The invention is based on a non-rotationally symmetrical spark gap according to claim 1, in particular a horn spark gap with a deion chamber, and a multi-part insulating material housing as a support and receiving body for the horn electrodes and the deion chamber, and means for conducting the gas flow related to the arc, wherein the insulating material housing is divided on the plane defined by the horn electrodes and has two half shells, and plug or screw connections which lead out on the end face.

(2) Description of Related Art

From the generic DE 10 2011 102 257 A1, a horn spark gap with a deion chamber in a non-blowing out design having a multi-part insulating material housing is already known.

The insulating material housing forms a support and receiving body for the horn electrodes and the deion chamber. Moreover, means for conducting the gas flow related to the arc are provided, wherein the insulating material housing is divided on the plane defined by the horn electrodes and forms a first and a second half shell.

The horn electrodes therein are realized in an asymmetrical form. The arc running area between the electrodes is delimited in the direction of the deion chamber by a plate-shaped insulating material, with the plate-shaped insulating material being inserted respectively in a first formation of the respective half shell in a form-fit manner.

The half shells include further, second formations encompassing the deion chamber part in a form-fit manner, wherein break-throughs or openings are situated in the respective half shell between each of the first and second formations, and the shorter one of the electrodes end in front of the deion chamber part, so that the gas flow related to the arc gets only partially into the deion chamber. Such a horn spark gap with a deion chamber and a multi-part insulating material housing may be produced in a cost-effective manner, is space-saving and may be built in a modular way, and can be configured to be flexible with respect to the construction. The essential assemblies of the already known spark gap, as well as the electrodes, a trigger electrode that is possibly provided and/or the deion chambers are exchangeable and may easily adapted to the respective grid conditions without having to depart from the basic construction.

The integration of all of the functional assemblies in the unit without an outer housing permits various device realizations for different grid configurations to be designed in the simplest manner. The individual parts of the spark gap may be interconnected by standard technologies such as, for example, rivets, screws or interlocking. Due to the gas conduction with several circulation circuits, all of the relevant components are utilized to cool the hot, ionized gases.

It has been shown, however, that in particular at higher loads in the case of surge currents in the range from 12.5 kA to 25 kA, the ionized gases developing have a very high thermal energy. Although all of the relevant components are utilized for cooling in the already known spark gap, limits come about at higher loads which possibly might result in a failure of the corresponding spark gap.

BRIEF SUMMARY OF THE INVENTION

From the aforementioned, it is therefore a task of the invention to propose a further developed, non-rotationally symmetrical horn spark gap, in particular a horn spark gap with a deion chamber, which is capable of withstanding even higher surge currents in the range from 12.5 kA to 25 kA without function disturbing or function endangering impairments being generated. The solution to be created should be performed under the aspect of maintaining the realization of the narrow construction of the known horn spark gaps depicted at the beginning so that, as a whole, only a smaller constructional space is occupied or required even in building up modules from several spark gaps.

The solution of the task of the invention is performed by a non-rotationally symmetrical spark gap according to the feature combination as per claim 1, in particular horn spark gap, with a deion chamber, with the dependent claims representing at least appropriate realizations and further developments.

Accordingly, a non-rotationally symmetrical spark gap is taken as a basis. This spark gap is in particular a horn spark gap with a deion chamber and a multi-piece, narrow, cuboid housing of insulating material as a support and receiving body for the horn electrodes and the deion chamber. Furthermore, the spark gap includes means for conducting the gas flow related to the arc, wherein the insulating material housing is or can be divided on the plane defined by the horn electrodes and has two half shells. Furthermore, plug or screw connections are leading out on the end face.

According to the invention, with the exception of the sections of the plug or screw connections leading out, the insulating material housing is surrounded on all sides by a cooling surface which is near the housing and lies against the housing surface.

The cooling surface is at least partly supported on webs which are designed to conduct the gas flow on the outer surface of the half shells. Due to the latter measure, the desired gas flow will not be impeded, and, at the same time, a close contact between the gas flow and the cooling surface will be ensured.

In a further development of the invention, the cooling surface is formed as a sheathing and will be jointly connected to the half shells. This connection may be performed in a force-fit manner but also by a combination of form fit and force fit or by material fit.

The cooling surface formed as a sheathing may have beads or embossings increasing stability.

Basically, it has to be stated that it is advantageous for the sheathing to be realized from a material that is of good heat conduction. This may be a metallic material but also heat-conducting plastic.

In a further development of the invention, a slip body may be slid upon the half shells at the front-side end of the plug and screw connections leading out. In this case, the slip body overlays at least one, preferably two facing fastening lugs which are an integral part of the sheathing.

In the covering area of the slip body overlaying the fastening lugs, bores or recesses for force-fit connecting are provided.

In a realization where the sheathing is made from an electrically conductive material, an insulating layer, for example, of a paper-like insulating material, is disposed between the outer surfaces of the half shells and the sheathing.

For enlarging the heat-relevant surface area, the outer sides of the sheathing may be structured.

For an easier overlaying of the fastening lugs, the slip body is provided with a corresponding respective wedge inclination in a further development of the invention.

The sheathing mentioned as a cooling surface may preferably be realized as a hood that may be slid on.

The invention will be explained below in more detail on the basis of an exemplary embodiment and referring to Figures.

BRIEF DESCRIPTION OF THE SEVERAL VIEWS OF THE DRAWINGS(S)

FIG. 4 shows the non-rotationally symmetrical spark gap formed in accordance with a second exemplary embodiment of the invention with a metallic hood as a cooling surface as well as an intermediate insulation and a slip body in an exploded view prior to the mounting operation realized by sliding on;

Figure 1:
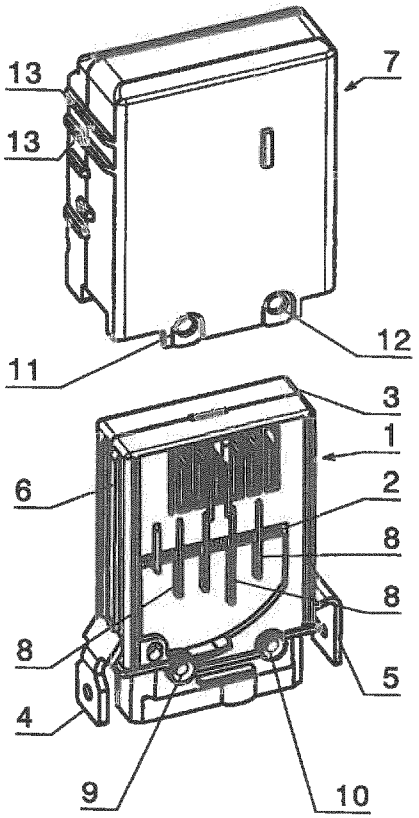
FIG. 1 shows the non-rotationally symmetrical spark gap formed in accordance with a first embodiment of the invention with a cooling surface, formed as a sheathing, in the form of a hood that may be slid on prior to the step of sliding it onto the horn spark gap with a deion chamber.
Figure 6:
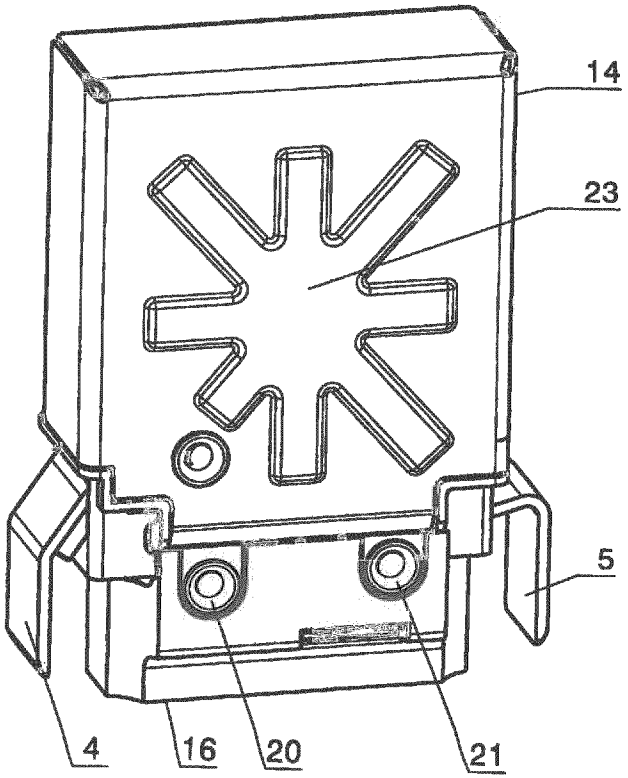
Figure 5:
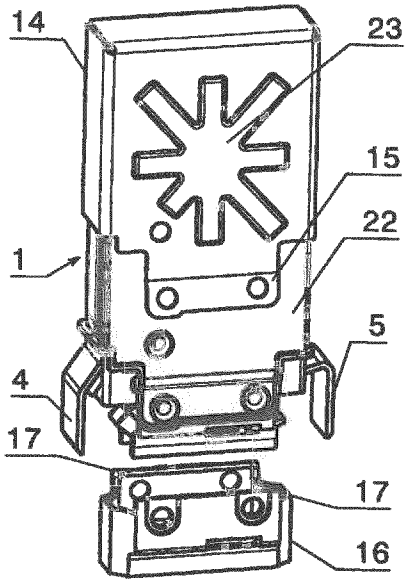

FIG. 5 shows the non-rotationally symmetrical spark gap formed in accordance with a second exemplary embodiment of the invention a representation similar to that according to FIG. 1, however, with an already partially slid on metallic hood; and FIG. 6 shows the non-rotationally symmetrical spark gap formed in accordance with a second exemplary embodiment of the invention, wherein, when the metallic hood is completely slid on, the slip body encompasses fastening lugs on the side of the hood, and is also in its end position, however, prior to the positive connection by, for example, riveting that still needs to be executed.

DETAILED DESCRIPTION OF THE INVENTION

Figure 3:
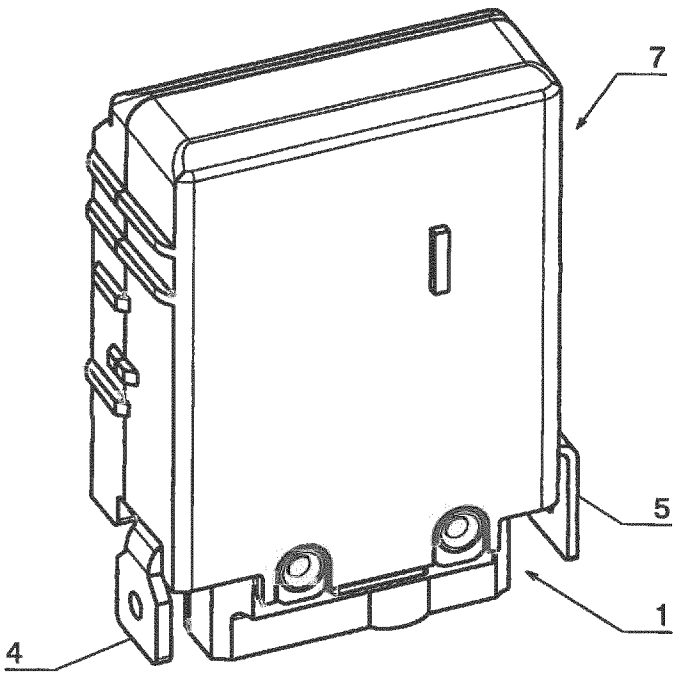
FIG. 3 shows the non-rotationally symmetrical spark gap formed in accordance with a first embodiment of the invention with the hood completely slid on prior to executing a riveting operation.
Figure 2:
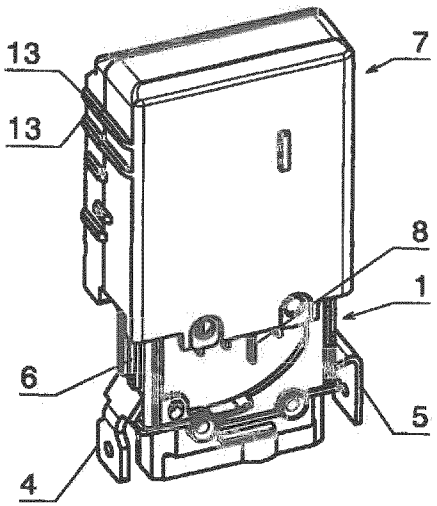
FIG. 2 shows the non-rotationally symmetrical spark gap formed in accordance with a first embodiment of the invention with a partially slid on hood.

The non-rotationally symmetrical spark gap of the invention according to FIGS. 1 to 3 first takes a support and receiving body for horn electrodes occluded in the Figures and the partially visible deion chamber 2 as a basis. Furthermore, interspaces for conducting the gas flow related to the arc are visible. The insulating material housing, respectively the support and receiving body, is divided along line 3 in the plane defined by the horn electrodes, and thus results in two half shells.

Plug or screw connections 4; 5 are leading out on the end face.

Guiding grooves 6 provided on the lateral narrow sides serve to slide on the sheathing 7 formed as a cooling surface in a correct position, which sheathing has correspondingly complementary protrusions (not shown) in the interior.

Furthermore, on the outer surfaces of the support and receiving bodies 1 formed as half shells, webs 8 serving to conduct the gas flow are present. In the shown example, the gas flow is here at least in part returned to the ignition area of the horn spark gap electrodes.

The cooling surface 7 formed as a sheathing is realized in the form of a hood.

With the exception of the sections of the plug or screw connection 4; 5 leading out, the support and receiving body 1 is correspondingly surrounded on all sides by a cooling surface which is near the housing and lies against the housing surface.

The cooling surface, respectively the hood 7, partly supports in this case on the webs by its inner sides, which webs are formed to conduct the gas flow on the outer surface of the corresponding half shell.

Due to this form of realization, the necessary mechanical stability is achieved, on the one hand. On the other hand, the gas flow remains unimpeded and may get into close contact with the cooling surface.

The sheathing 7 or the corresponding hood may be connected jointly to the corresponding half shells. In this respect, passage openings 9 and 10 or 11 and 12 are present which receive screws or rivets.

The cooling surface formed as a sheathing may have embossings 13 increasing stability.

Figure 4:
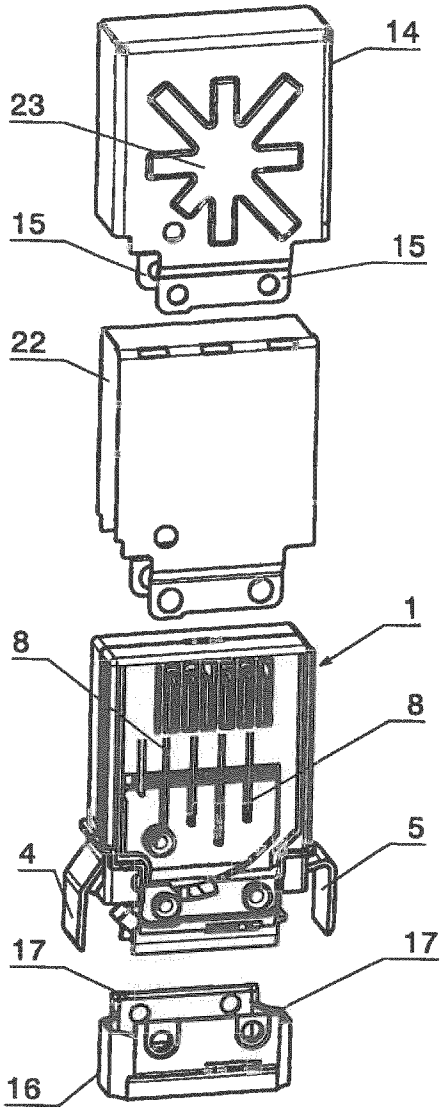

According to the embodiment as per FIGS. 4 to 6, a further development of the cooling surface formed as a sheathing is performed. In the example according to FIGS. 4 to 6, a metallic hood 14 is taken as a basis.

On its front and rear side, this metallic hood 14 includes in each case a fastening lug 15.

Furthermore, a slip body 16 is present.

This slip body may be slid onto the support and receiving body in its end side lower area.

It is apparent from the sequence of FIGS. 4 to 6 that the slip body 16 overlays and additionally secures the respective fastening lugs 15 of the hood with wedge inclinations 17 provided on the slip body. Bores or recesses 20; 21 now act as the positive connection of the parts mentioned before and the arrangement resulting therefrom.

Also, in this exemplary embodiment, webs 8 are present, on which the cooling surface 14 formed as a sheathing may support without the gas flow being disturbed which develops after arc ignition.

If, as shown in FIGS. 4 to 6, when the sheathing of a metallic material according to the hood 14 is formed, the material itself is electrically conductive, an insulation intermediate layer 22 which may be formed, for example, as a U-shaped pattern, will be disposed between the support and receiving body 1 and the hood 14.

As already depicted, the outer sides of the sheathing, apart from an embossing increasing stability, may be structured for enlarging the heat-relevant surface area. Such a structure 23 is indicated in FIGS. 4 to 6.

What is claimed is:

1. A non-rotationally symmetrical horn spark gap with horn electrodes, a deion chamber and a multi-part insulating material housing as a support and receiving body (1) for the horn electrodes and the deion chamber (2), and means for conducting a gas flow related to an arc, wherein the insulating material housing is divided on a plane (3) defined by the horn electrodes and has two half shells, the half shells having an outer surface, and plug or screw connections (4; 5) which are lead out on an end face;

characterized in that, with exception of sections of the plug or screw connections (4; 5) which are lead out, the insulating material housing is surrounded on all sides by a cooling surface (7; 14) formed as a sheathing which is near the housing and lies against the housing surface, wherein the cooling surface (7; 14) formed as a sheathing is at least partly supported on webs (8) present on the outer surface of the half shells which are designed to conduct the gas flow on the outer surface of the half shells.

2. The non-rotationally symmetrical horn spark gap according to claim 1, characterized in that the cooling surface (7;14) formed as a sheathing is jointly connected to the half shells.

3. The non-rotationally symmetrical horn spark gap according to claim 1, characterized in that the cooling surface (7;14) formed as a sheathing has beads or embossings (13; 23) for increasing stability.

4. The non-rotationally symmetrical horn spark gap according to claim 1, characterized in that the sheathing is composed of a material that is of good heat conduction.

5. The non-rotationally symmetrical horn spark gap according to claim 1, characterized in that, at a front-side end of the plug or screw connections (4; 5) which are lead out, a slip body (16) is slid upon the half shells, which overlays at least one fastening lug (15) at least in part, wherein the at least one fastening lug (15) is an integral part of the sheathing.

6. The non-rotationally symmetrical horn spark gap according to claim 5, characterized in that in a covering area of the slip body (16) overlaying the fastening lug, bores or recesses (20; 21) for force-fit connecting are provided in the support and receiving body (1).

7. The non-rotationally symmetrical horn spark gap according to claim 1, characterized in that in a realization of the sheathing (14) from an electrically conductive material, an insulating layer (22) is disposed between the outer surface of the half shells and the sheathing.

8. The non-rotationally symmetrical horn spark gap according to claim 1, characterized in that, for enlarging a heat-relevant surface area, outer sides of the sheathing have a structuring (23).

9. The non-rotationally symmetrical horn spark gap according to claim 5, characterized in that, for an easier overlaying of the fastening lugs (15), the slip body (16) has a wedge inclination (17).

10. The non-rotationally symmetrical horn spark gap according to claim 1, characterized in that the sheathing is realized as a hood that is slid on.

* * * * *